United States Patent [19]

Nashawaty

[11] 4,446,455

[45] May 1, 1984

[54] STOVE ALARM SYSTEM

[76] Inventor: Ralph G. Nashawaty, 30 Ridgewood Dr., Norwood, Mass. 02062

[21] Appl. No.: 238,695

[22] Filed: Feb. 27, 1981

[51] Int. Cl.[3] ..... H05B 1/02

[52] U.S. Cl. ..... 340/568; 219/452; 219/518

[58] Field of Search ..... 340/568, 613; 219/452, 219/518

[56] References Cited

U.S. PATENT DOCUMENTS 4,164,644 8/1979 Remsnyder et al. ..... 219/518

4,334,145 6/1982 Norris, Sr. ..... 219/518

*Primary Examiner*—Glen R. Swann, III

*Attorney, Agent, or Firm*—Joseph S. Iandiorio

[57] ABSTRACT

An alarm system for use in a stove having a burner and control device for turning on and off the burner is provided, including an audio/visual alarm device and an alarm circuit for activating the alarm device. A low-voltage power supply energizes the alarm circuit. A sensor is mounted with the burner for sensing the presence and absence of a utensil thereon. A first switch in the alarm circuit closes a first set of contacts in response to the control device being in the burner-on position. A second switch in the alarm circuit closes a second set of contacts in the absence of a utensil on the burner, thereby completing the alarm circuit and activating the audio/visual alarm device.

11 Claims, 4 Drawing Figures

STOVE ALARM SYSTEM

FIELD OF INVENTION

This invention relates to an alarm system for use in a stove having a burner and control device for turning on and off the burner.

BACKGROUND OF INVENTION

A common household annoyance and danger occurs when a kitchen range burner is operated without a utensil being present thereon. This may occur when the control knob is left in a burner-on condition after the utensil has been removed. Alternatively, the operator may activate the burner intending to utilize it, only to be interrupted in his kitchen task and forget that the unemployed burner remains on.

This problem can easily avoid the operator's attention, especially at very low heat levels (e.g., when the burner control knob is in a low-heat position), where it is often impossible to visibly detect that the burner is operating. An electric burner may not glow, and the gas flame is reduced in size at such low heat levels.

Operating a burner without the utensil present wastes energy. It also creates a safety hazard which may result in serious burns for the unwary operator, especially when the burner is on the low setting where the operator may not notice that the burner is hot.

Conventional devices do not adequately solve this problem. One device depicts an alarm device which indicates that less than a desired weight is on the burner. However, that device is basically a measuring mechanism and does not operate to indicate that the stove burner is turned on: the alarm functions completely independently of the stove burner and its control knob. Another device uses an electric heating element which is activated when a utensil is placed upon it. However, such a device must be wired as part of the burner and is not designed to be installed in existing burners. Further, this device functions only with electric, and not with gas, burners.

SUMMARY OF INVENTION

It is therefore an object of this invention to provide an alarm system for use in a stove having a burner and control device for turning on and off the burner which is operated to indicate the absence of a utensil on the burner while the burner control device is in the burner-on condition.

It is a further object of this invention to provide an improved alarm system for use in a stove having a burner and control device for turning on and off the burner which is adaptable to all varieties of burners.

It is a further object of this invention to provide an alarm system for use in a stove having a burner and control device for turning on and off the burner which may be installed in any existing range.

It is a further object of this invention to provide an alarm system for use in a kitchen range having a plurality of burners and corresponding control devices for turning on and off the burners which is operated to indicate the absence of a utensil on any one of the burners while that burner's control device is in the on condition.

This invention features an alarm system for use in a stove having a burner and control device for turning on and off the burner. There is an alarm device including an alarm circuit for activating the alarm device. Sensor means sense the presence and absence of a utensil on the burner. First switching means in the alarm circuit close a first set of contacts in the alarm circuit in response to the control device being in the on condition. Second switching means in the alarm circuit close a second set of contacts in series with the first set of contacts, in the absence of a utensil on the burner to complete the alarm circuit and activate the alarm device.

In a preferred embodiment, the alarm device may be audio, visual, or both audio and visual. The sensor means may include an actuator member having one end which extends above the burner. Biasing means urge the actuator member to extend above the burner in the absence of a utensil on the burner, and allow retraction of the actuator member in the presence of a utensil on the burner. The second switching means may be operated by the actuator member and may include a microswitch.

This invention also features an alarm system for use in a kitchen range having a plurality of burners and corresponding control devices for turning on and off the burners. There is an alarm device and an alarm circuit associated with each burner for activating the alarm device. Sensor means are mounted with each of the burners for sensing the presence or absence of a utensil thereon. A plurality of first switches, each closes a corresponding set of first contacts in said alarm circuit in response to the corresponding control device being in the burner-on condition. The first sets of contacts are connected in parallel. A plurality of second switches each closes a corresponding set of second contacts in the alarm circuit in the absence of a utensil on the burner to complete the alarm circuit and activate the alarm device.

DISCLOSURE OF PREFERRED EMBODIMENT

Other objects, features and advantages will occur from the following description of a preferred embodiment and the accompanying drawings, in which.

Figure 1:
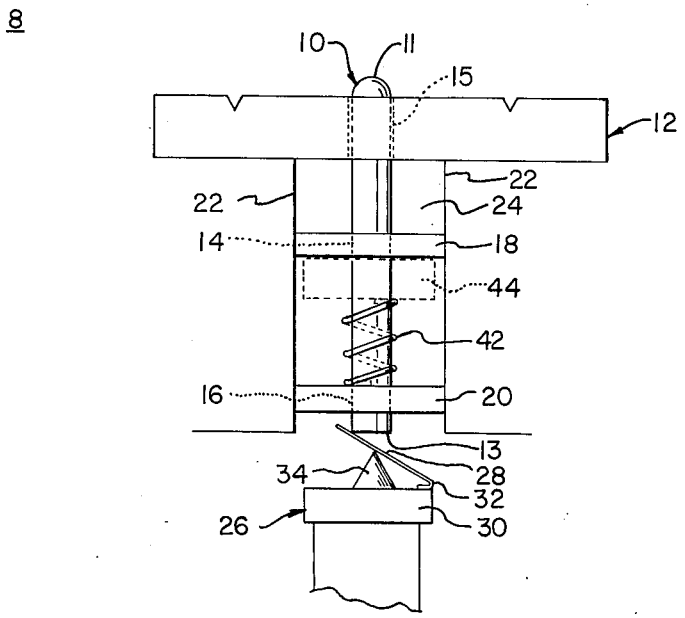
FIG. 1 is a front elevational cross-sectional view of sensor means mounted with a kitchen range burner in the absence of a utensil thereon and a second switching means of an alarm circuit according to this invention.

An alarm system for use in a kitchen range having a burner and a control device for turning on and off the burner may be effected using an alarm device which may be audio and/or visual, e.g. a blinking light, chimes, or a buzzer. An alarm circuit is included for activating the alarm device.

The alarm circuit includes first and second switching means. The first switching means closes a first set of contacts in response to the control device being in the burner-on condition. The control device typically operates the first switch mechanically but may also close the switch by magnetic relay, or other appropriate means. The second switching means closes a second set of contacts in series with the first set in the absence of a utensil on the burner, thus completing the circuit and activating the alarm device.

Sensor means are mounted with the burner for sensing the presence and absence of a utensil thereon. Such sensor means may include a generally elongate actuator member, extending above the burner. The actuator member may be aligned perpendicular to and extend through the center of the burner. The member may also be arranged in the burner in a slanted manner and may extend through the burner at a non-central location. Biasing means urges the actuator member to extend above the burner in the absence of a utensil on the burner and allows retraction of the actuator member in the presence of a utensil on the burner. The biasing means may be a resilient member connected to the second switching means and upon which the lower end of the actuator member sits. The resilient member resists retraction of the actuator member until sufficient weight is applied to the burner. Alternatively, upper and lower retaining rings may be provided underneath the burner through which the actuator member extends. A spring disposed about the actuator member between the rings bears on an actuator member flange to resist retraction of the actuator member. The burner itself may be resiliently mounted to the range. Sensor means such as a magnet may then be mounted to the burner and accordingly retracted and extended with the burner as a utensil is placed thereon or removed therefrom. The resilient means for mounting may be situated underneath the burner. When an actuator member is utilized, it is preferred that the member may retract and extend vertically, longitudinally, or by pivoting, or in any other suitable way.

The second switching means, typically a microswitch, is situated proximate the lower end of the actuator member. A second set of contacts is opened by retraction and closed by extension of the actuator member or other sensor means. In one actuator member/microswitch combination a weight of 45 grams on the actuator member overcomes the resistance of a resilient switch member and causes the microswitch to open a second set of contacts in the alarm circuit. Alternative sensor means may include photoelectric, magnetic, or other suitable sensing mechanisms.

An alarm system for use with a kitchen range having a plurality of burners and corresponding control devices may be effected by including the sensor means heretofore described, with each burner. The alarm circuit described is modified simply by adding additional pairs of first and second switches (and respective sets of contacts) in parallel to accommodate any number of burners.

There is shown in FIG. 1 an alarm system 8 according to this invention, with a portion of the circuit omitted, mounted on stove burner 12. Actuator member 10, having upper end 11 and lower end 13, extends through opening 15 of burner 12 and through openings 14 and 16 of retainer rings 18 and 20 which are mounted to the wall 22 of recess 24. Openings 14 and 16 and burner opening 15 are of sufficient diameter to allow motion of member 10.

Switching means includes a normally closed microswitch 26 having switch member 28 pivotably attached at 32 to switch body 30. Switch member 28 maintains a position where it acts as a seat for member 10. The weight of member 10 is such that when a utensil is absent from burner 12, member 28 maintains its raised position and supports member 10 in an extended position where upper end 11 protrudes from the top of burner 12. In the position shown, the contacts of switch 26 are closed.

Figure 2:
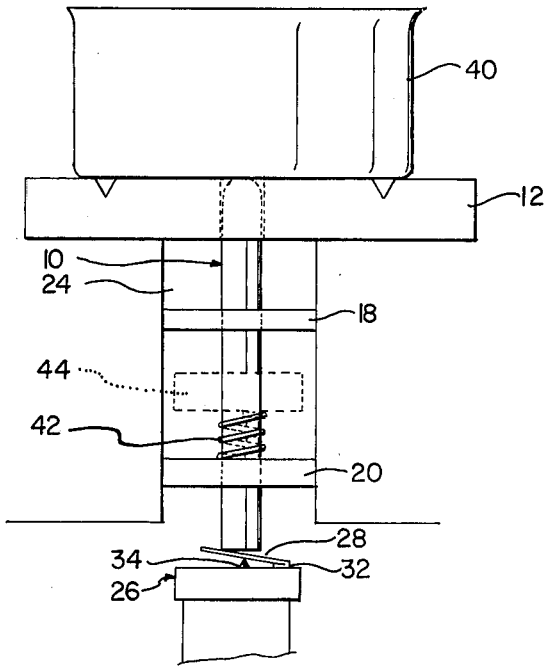
FIG. 2 is a similar view of the sensor means mounted with the burner in the presence of a utensil and the second switching means of the alarm circuit.

When utensil 40, FIG. 2, is placed on burner 12, member 10 is urged to retract within recess 24. The resistance of member 28 is overcome and the contacts are opened. Removal of the utensil allows member 28 to regain its raised position, FIG. 1, and extend member 10.

Alternative biasing means may include spring 42, FIGS. 1 and 2, disposed about member 10 between rings 18 and 20, which urges flange 44 of member 10 toward ring 18, thereby maintaining member 10 in an extended position when a utensil is absent. Placing a utensil on the burner causes retraction of member 10, FIG. 2, which results in flange 44 compressing spring 42. When the utensil is removed spring 42 expands, thus extending member 10.

Member 10 may be mounted with a single burner device such as a "hot plate". Alternatively, multiple burners 12, 12', 12'', 12''', FIG. 3, may each be equipped with such sensors. Members 10, 10', 10'', and 10''' extend through top-to-bottom openings 15, 15', 15'', and 15''', typically at the center of the respective burners. The burners of FIG. 3 are illustrated as electric, but they may be alternatively operated by any acceptable power, such as gas.

Figure 4:
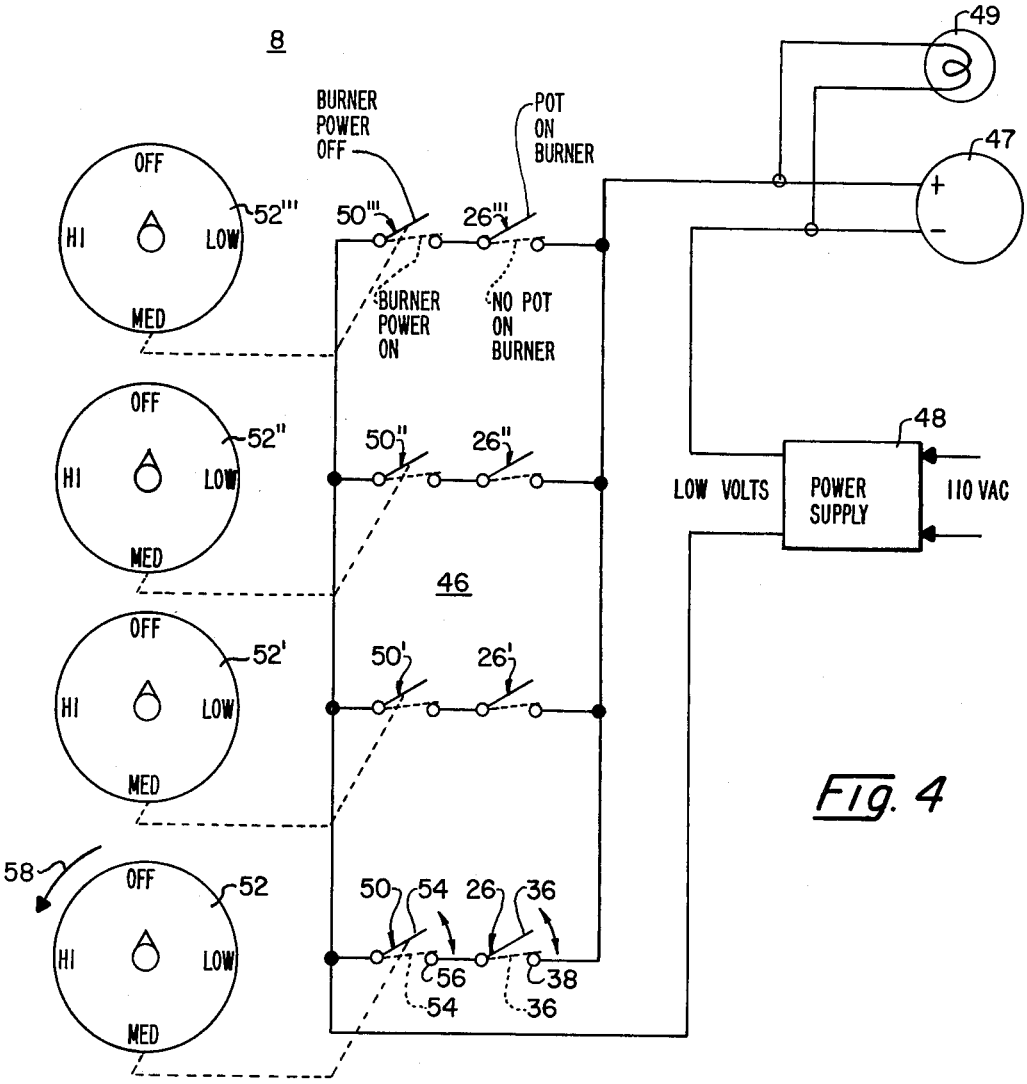
FIG. 4 is a schematic view of an alarm circuit for activating an alarm device according to this invention accommodating multiple burners and corresponding control devices.

An alarm system 8 according to this invention including alarm circuit 46, FIG. 4, for activating an audible alarm 47 and a visual alarm, lamp 49, includes a power supply 48. A first switch 50 is controlled, mechanically or otherwise, by control device 52 to open and close contacts 54 and 56 in series with contacts 36 and 38 of microswitch 26. Control device 52 in the burner-off condition causes switch 50 to open contacts 54 and 56. Turning control device 52 in the direction of arrow 58 to the burner-on condition closes contacts 54 and 56 as in the phantom. If contemporaneously no utensil is on the burner switch 26 is closed as previously described and completes circuit 46, thus activating the alarm devices 47 and 49.

Figure 3:
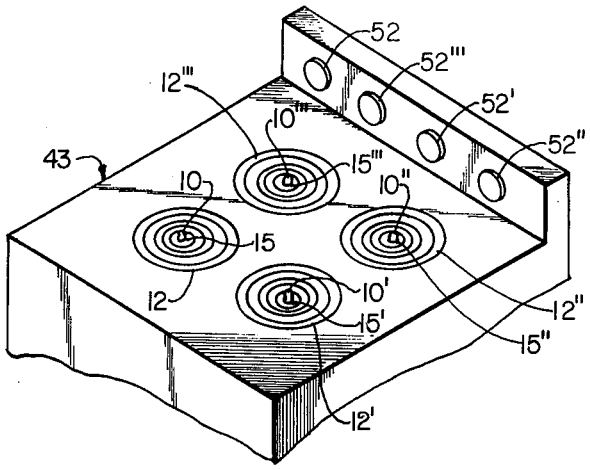
FIG. 3 is an axonometric view of a kitchen range having multiple burners and sensor means according to this invention.

Additional pairs of first switches 50', 50'', and 50''', operated by control devices 52', 52'', and 52''', and second switches 26', 26'' and 26''', corresponding to burners 12', 12'', and 12''', FIG. 3, may be included in circuit 46; each pair of first or second switch contacts is connected in parallel, FIG. 4, with all other such pairs.

Other embodiments will occur to those skilled in the art and are within the following claims:

What is claimed is:

1. An alarm system for use in a stove having a burner and a control device for turning on and off the burner, the improvement comprising:

an alarm device;

an alarm circuit for activating said alarm device;

a low voltage power supply for energizing said alarm circuit independently of said burner;

sensor means for sensing the presence or absence of a utensil on said burner;

first switching means in said alarm circuit for closing a first set of contacts in said alarm circuit in response to said control device being in the burner-on condition; and second switching means disposed in said alarm circuit and having a second set of contacts in series with said first set of contacts said second set of contacts closing in response to the sensing by said sensor means of the absence of a utensil on said burner to complete the alarm circuit and activate the alarm device when said control device is in the burner-on condition and no utensil is on the burner.

2. The system of claim 1 in which said alarm device is audio.

3. The system of claim 1 in which said alarm device is visual.

4. The system of claim 1 in which said alarm device is audio and visual.

5. The system of claim 1 in which said alarm device includes chimes or a buzzer.

6. The system of claim 1 in which said sensor means includes an actuator member.

7. The system of claim 6 in which said actuator member extends above said burner.

8. The system of claim 7 in which said sensor means includes biasing means for urging said actuator member to extend above said burner in the absence of a utensil on said burner and allowing retraction of said actuator member in response to the presence of a utensil on said burner.

9. The system of claim 6 in which said second switching means is operated by said actuator member.

10. The system of claim 1 in which said second switching means includes a microswitch.

11. An alarm system for use in a kitchen range having a plurality of burners and corresponding control devices for turning on and off the burners, comprising:

an alarm device;

an alarm circuit associated with each burner for activating said alarm device;

a low voltage power supply for energizing said alarm circuit independently of said burners;

sensor means mounted with each of said burners for sensing the presence or absence of a utensil on a burner;

a plurality of first switching means each closing, in response to the corresponding control device's being in the burner-on condition, a corresponding set of first contacts in said alarm circuit, said sets of first contacts being connected in parallel; and a plurality of second switching means in said alarm circuit each having a set of second contacts in series with the corresponding set of first contacts each set of second contacts closing when the corresponding sensor means senses the absence of a utensil on the burner corresponding to complete the alarm circuit and activate the alarm device when any control device is in the burner-on condition and no utensil is on the corresponding burner.

* * * * *